US011566782B2

(12) United States Patent
Christensen

(10) Patent No.: US 11,566,782 B2
(45) Date of Patent: Jan. 31, 2023

(54) LIGHTING DEVICE WITH VENTILATION

(71) Applicant: SGM Light A/S, Aarhus V (DK)

(72) Inventor: Poul Brix Christensen, Galten (DK)

(73) Assignee: SGM Light A/S, Aarhus V (DK)

( * ) Notice: Subject to any disclaimer, the term of this patent is extended or adjusted under 35 U.S.C. 154(b) by 0 days.

(21) Appl. No.: 17/489,141

(22) Filed: Sep. 29, 2021

(65) Prior Publication Data

US 2022/0018530 A1 Jan. 20, 2022

Related U.S. Application Data

(63) Continuation of application No. PCT/EP2020/059060, filed on Mar. 31, 2020.

(30) Foreign Application Priority Data

Apr. 1, 2019 (DK) ..... PA201970198

(51) Int. Cl.

| | |
|---|---|
| ***F21V 31/03*** | (2006.01) |
| ***F21V 21/15*** | (2006.01) |
| ***F21V 21/30*** | (2006.01) |
| *F21W 131/406* | (2006.01) |

(52) U.S. Cl.

CPC ..... *F21V 31/03* (2013.01); *F21V 21/15* (2013.01); *F21V 21/30* (2013.01); *F21W 2131/406* (2013.01)

(58) Field of Classification Search

CPC .... F21W 2113/406; F21V 21/15; F21V 31/03
See application file for complete search history.

(56) References Cited

U.S. PATENT DOCUMENTS

| | | | | |
|---|---|---|---|---|
| 2001/0006218 | A1 | 7/2001 | Takada | |
| 2004/0155590 | A1 | 8/2004 | Belliveau | |
| 2006/0023168 | A1 * | 2/2006 | Belliveau | H05B 47/18 353/57 |
| 2020/0173725 | A1 | 6/2020 | Jiang | |

FOREIGN PATENT DOCUMENTS

| | | | | |
|---|---|---|---|---|
| CN | 208074728 | U | | 4/2018 |
| EP | 3153768 | A1 | | 4/2017 |
| JP | H09-140111 | A | | 5/1997 |
| JP | H09140111 | A | * | 5/1997 |
| JP | 2018-197668 | A | | 12/2018 |
| WO | WO 2016/079308 | A1 | | 5/2016 |
| WO | WO 2019/029495 | A1 | | 2/2019 |

OTHER PUBLICATIONS

International Search Report and Written Opinion of International Searching Authority for Application No. PCT/EP2020/059060, dated May 20, 2020 (10 pages).

Danish Patent Office; First Technical Examination and Search Report for Patent Application No. PA201970198, dated Sep. 23, 2021 (6 pages).

* cited by examiner

*Primary Examiner* — Anabel Ton

(74) *Attorney, Agent, or Firm* — Day Pitney LLP; Anthony A. Kassas

(57) ABSTRACT

A lighting device configured for professional illumination. The lighting device includes a head and a component emitting oil fumes, and a fluid tight housing. An oil fume absorbing filter is arranged within the housing.

14 Claims, 3 Drawing Sheets

LIGHTING DEVICE WITH VENTILATION

CROSS-REFERENCE TO RELATED APPLICATIONS

This application is a continuation of International Application No. PCT/EP2020/059060, filed Mar. 31, 2020, which claims priority to and the benefit of Denmark Patent Application No. PA201970198, filed Apr. 1, 2019, both of which are incorporated herein by reference in their entireties.

FIELD OF THE INVENTION

The present invention relates generally to a motorised lighting device for professional illumination, for example to be used to illuminate a given environment.

BACKGROUND

Lighting devices of various types for professional illumination of a given environment are generally known.

One or more of such lighting devices may e.g. be used to illuminate a stage, stadium, arena, or other areas during events like a music concert, theatre performance, a fashion show, a sporting event, a convention, etc.

One or more of such lighting devices may e.g. also be used to illuminate at least a part of a building, a landmark, a sporting field, a monument, or the like.

Additionally, one or more of such lighting devices may e.g. also be used to illuminate an environment or one or more parts thereof e.g. in connection with an event. This may e.g. be illuminating air by light in particular if the air contains moisture, dust, smoke, or other.

The one or more lighting devices may be installed and used more or less permanently or for a longer period of time, e.g. for illumination of a building, landmark, or the like, or for a shorter period of time, e.g. for illumination of a stage during a concert, sporting event, or the like.

In general, one or more of such professional lighting devices may be used to illuminate basically any environment or parts thereof, and/or object(s) either permanently or temporarily.

Professional lighting devices normally have some characteristics that set them further apart (than just being of another use) from lighting devices for personal/home use, such as minimum durability, illuminance and luminous emittance, reliability, etc.

Lighting devices are known which comprise a light source that can be moved in more or less any desired orientation, so that a light beam emitted by a light source can be directed along basically any desired direction (there may be one or more blind spots or areas but then normally of no practical consequence given a sufficient distance between the lighting device and the environment to be illuminated).

To this end, the light source is supported by the lighting device and may be rotated about one or two axes by use of suitable motors or similar.

Such lighting devices are within the professional lighting segment sometimes referred to as moving heads.

They are during use normally placed on a substantially flat or horizontal surface or suspended from or mounted on an appropriate frame, rack, stand, support, or the like.

The illumination need not only be static (although it can be) but may also be dynamic, e.g. as sometimes used during concerts, sporting events, etc., where the light source(s) of the lighting device(s) is/are moved over time in a controlled and/or pre-determined or programmed manner.

There is often a need for outdoor use of such lighting devices in an outdoor environment. For this purpose the lighting devices should preferably be protected against humidity and dust and other environmental hazards.

In order to solve this problem, such lighting devices may be manufactured with completely closed housings, where the components of the lighting devices are enclosed in a housing devoid of openings and where shell parts of the housing is provided with gaskets in order to make the lighting device completely water/air tight—or at least as water/air tight as possible. Such lighting devices may be manufactured to comply with national or international standards. For example it is desired that such lighting devices may comply with the International Electrotechnical Commission (IEC) standard, e.g. IEC 60529, where the Ingress Protection Rating is IP65, IP66 or higher.

As mentioned above, such lighting devices are equipped with motors in order to control a lighting direction. Such motors or actuators and in some instances also rotational joints of the lighting devices need to be lubricated in order to function correctly over prolonged periods of time. Common lubricants and oils have an evaporation temperature, such as say 72° C.

It has been found that the temperature inside the housings of lighting devices such as described above may occasionally reach temperatures above the evaporation point despite the use of modern light sources. When the oil evaporates, and cannot ventilate to the outside environment due to a dust and moisture tight housing of the lighting device there is a risk that the oil will condense on vital electrical component or on the lens or other optics in portions/parts of the lighting device where the temperature is lower or when the lighting device is turned off. Condensed oil on electrical components may cause malfunction thereof. Condensed oil on the lens may influence the quality of light emitted from the lighting device. Both situations are undesirable.

Therefore it is an object of the present invention to alleviate the problem of condensing oil in dust and water/moisture tight professional lighting devices.

SUMMARY OF THE INVENTION

According to a first aspect, objects of the invention are obtained, at least in part, by a lighting device configured for professional illumination, the lighting device comprising a head and a component emitting oil fumes, the lighting device comprising a fluid tight housing, and where an oil fume absorbing filter is arranged within said housing.

The components emitting oil fumes may—dependent on a temperature in the fluid tight housing and on an evaporation temperature of the oil used in the oil emitting component—emit oil fumes due to the heat produced in the housing. Heat may for example be produced by components such as a light source of the head.

The fluid tight housing, or fluid tight sub-parts thereof, may be constructed in such a way that any oil fumes are led past the oil fume absorbing filter, for example by the natural convection induced by heat-producing components between warmer and colder areas of the fluid tight housing. For example, the lighting device may be designed such that there are pathways in the housing that will lead fumes to the filter instead of trapping them at undesired locations. This may be done by positioning heat-emitting components appropriately relative to colder components, and/or by placing internal walls and fins, ducts, etc. to provide such pathways. Alternatively or additionally, the lighting device further comprises a ventilation device configured to force at least some air within the housing to pass through said oil fume absorbing filter.

The ventilation device may be a fan.

In a further embodiment, the oil fume absorbing filter and the ventilation device are arranged in a filter housing comprising an upstream channel provided between an inlet of the upstream channel and the oil fume absorbing filter. Thereby, the oil fume removing function may be applied as a unit, which provides easy manufacture, and which may also be retrofit in existing lighting devices.

In a further embodiment, the lighting device is provided with a support arrangement for supporting the head and where the inlet to the filter housing is provided in one of the head and the support arrangement, and the filter is provided in the other one of the head and the support arrangement.

In a further embodiment, the inlet to the filter housing is provided in the head of the lighting device, and an outlet from the filter housing is also provided in the head.

In a further embodiment, the filter housing comprises two or more upstream channels leading to the oil fume absorbing filter, each upstream channel having an inlet. In a further embodiment thereof each upstream channel comprises a ventilation device. In a further embodiment hereof, one inlet to the filter housing may be arranged in the head, and another inlet to the filter housing may be arranged in at least one part of the support arrangement or in each part of the support arrangement.

In an alternative embodiment, each of the head and the support structure may be provided with a filter housing comprising an oil fume absorbing filter, where an upstream channel is provided between an inlet of the upstream channel and the oil fume absorbing filter.

In a further embodiment, the filter housing has as dust filter arranged downstream of the oil fume absorbing filter. In a further embodiment thereof, the dust filter is a HEPA filter.

In a further embodiment, the oil fume absorbing filter is an active carbon filter.

In one embodiment the lighting device comprises a head movable relative to a support arrangement by one or more motors.

The one or more motors are preferably electrical motors. Preferably, the one or more motors are stepper motors.

In a further embodiment the lighting device further comprises a control unit connected to said ventilation device and configured to

- activate the ventilation device, when the lighting device is turned on and deactivate the ventilation device, when the lighting device is turned off;
- activate the ventilation device, when the lighting device is turned on, and deactivate the ventilation device a predetermined period of time after the lighting device is turned off; or
- activate the ventilation device in regular predetermined intervals of time after the lighting device is turned on.

Alternatively or additionally the lighting device may further comprise a control unit connected to said ventilation device and to at least one sensor, the sensor being arranged within said housing, and being configured to detect or measure a variable indicative of oil fumes being present in the housing, and where the control unit is configured to activate the ventilation device, based on input from the sensor, when the measured variable approaches or exceeds a threshold.

In an embodiment, the sensor is a temperature sensor, and the control unit is configured to activate the ventilation device, based on input from the sensor, when the measured temperature approaches or exceeds an evaporation temperature of the oil used in the oil fume emitting components.

BRIEF DESCRIPTION OF THE DRAWINGS

In the following, the first aspect will be described in greater detail with reference to embodiments shown by the enclosed figures. It should be emphasized that the shown embodiments are used for example purposes only and should not be used to limit the scope of the invention.

DETAILED DESCRIPTION

Various aspects and embodiments of a lighting device configured for professional illumination disclosed herein will now be described with reference to the figures.

Figure 1:
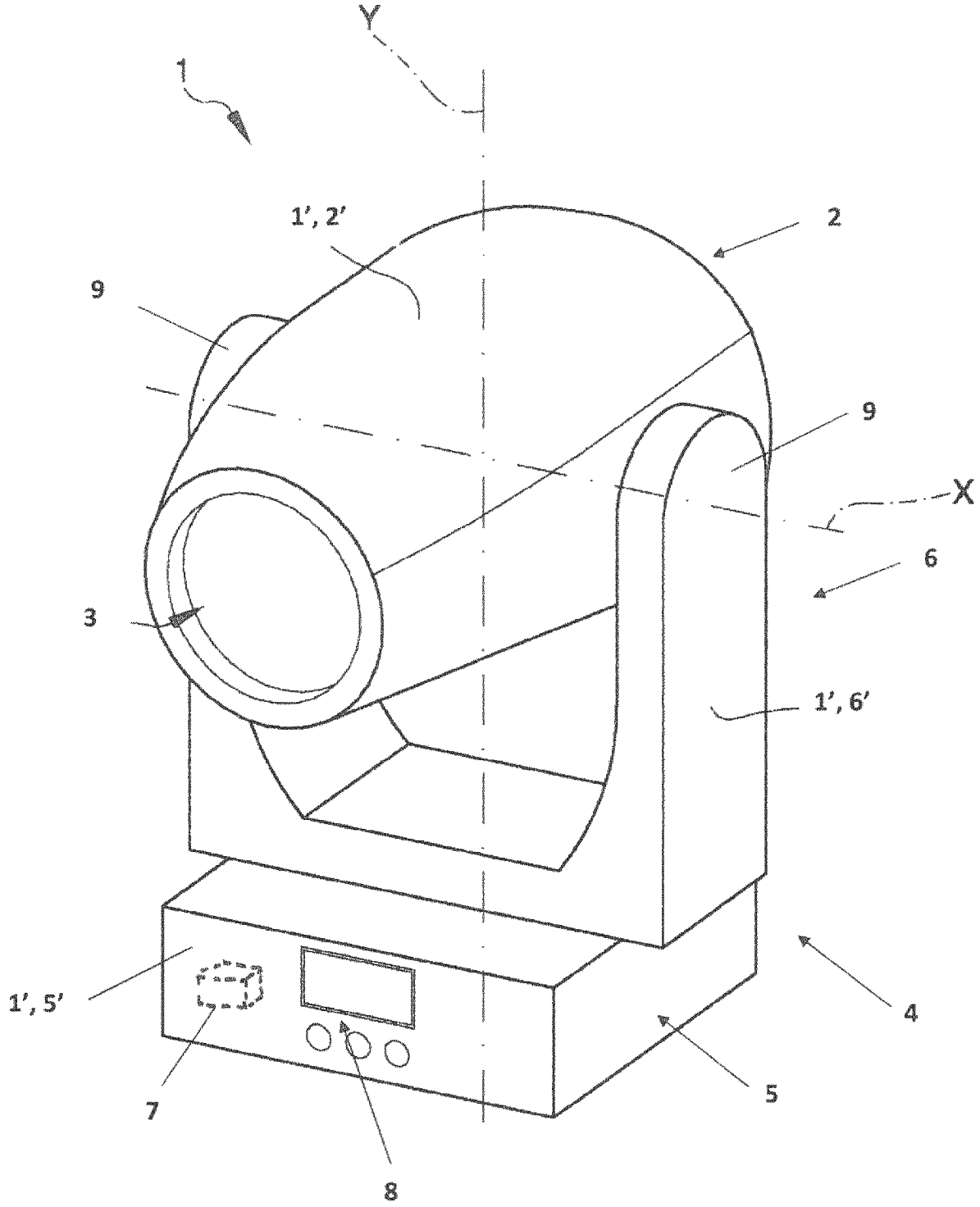
FIG. 1 is a perspective view schematically illustrating one embodiment of a lighting device.

FIG. 1 is a perspective view schematically illustrating one embodiment of a lighting device 1, also called a moving head lighting device. FIG. 1 schematically illustrates the lighting device 1 that may be used (e.g. together with one or more additional lighting devices of a same and/or different type(s)) to illuminate a stage, area, or other during events like a music concert, theatre performance, a fashion show, a sporting event, a convention, etc. One or more of such lighting devices 1 may e.g. also be used to illuminate at least a part of a building, a landmark, a sporting field, a monument, or the like.

The lighting device 1 may also be referred to as a lighting fixture or a projector.

The lighting device 1 comprises a housing 1'.

The lighting device 1 further comprises a light source (not shown in FIG. 1; see e.g. reference number 11 in FIG. 3) for emitting a light beam in a given direction. The light source 11 may be or comprise a lamp, for example a halogen lamp, a fluorescent lamp, a discharge lamp, or a light source comprising one or more light emission diodes (LEDs). More than one light source can be used in a single lighting device 1, as typically is the case of a lighting device 1 comprising a plurality of LEDs.

The light source 11 is housed inside a head 2, also called a moving head. The head 2 comprises a first housing part 2', for example made of a polymeric material. The first housing part 2' is provided with an opening 3 from which the light beam emitted by the light source 11 may exit. The opening 3 is provided with—and closed by—a light permeable closure (see e.g. 3' in FIGS. 2 and 3). The opening 3 may further be provided with lenses or other optics in order to control or influence the emitted light beam. In some instances the light permeable closure 3' may be a lens or other optics.

The head 2 with the first housing part 2' is supported by a support arrangement 4 that can be rested on a generally horizontal or planar surface, as shown in FIG. 1, or used to suspend the lighting device 1 from a fly system of a stage, etc. The support arrangement 4 may—as shown in FIG. 1—comprise a base 5 supporting a movable supporting element 6. The movable supporting element 6 is preferably connected to the base 5 in a rotational joint. In the embodiment shown in FIG. 1, the movable supporting element 6 is generally U-shaped or shaped as a yoke or similar, i.e. the movable supporting element 6 has two arms 9. However, other shapes of the movable supporting element 6 are also possible. For example, the movable supporting element 6 may have only one arm. The head 2 may—as shown—be rotationally connected to the arms 9 of the movable supporting element 6 in rotational joints.

The base 5 comprises a second housing part 5'. The second housing part 5' of the base 5 typically houses a control unit 7 or similar for controlling operation of the lighting device 1. A user may interact with the control unit(s) 7 through a user interface 8, e.g. comprising a plurality of push-buttons, knobs, a display, and/or other user interface elements, e.g. provided on the base 5. Alternatively or in addition, a user may interact with the control unit(s) 7 through remote control. In FIG. 1, a control unit 7 is illustrated symbolically by a box in dashed line inside the base 5.

The supporting element 6 may comprise a third housing part 6'.

In some embodiments (not shown), the control unit 7 may alternatively be provided in the first housing part 2' of the head 2, or in the third housing part 6' of the moveable supporting element 6.

The head 2 with the first housing part 2' may be rotated about a predetermined axis X, for example an at least substantially horizontal axis relative to the supporting element 6. Rotation may be provided by a given motor (not shown) of the lighting device 1. For example a motor may be located in one of the 'arms' 9 of the third housing part 6' of the U- or yoke shaped supporting element 6. The motor is preferably an electric motor such as a stepper motor. The rotation about the axis X may alternatively be accomplished using two electrical motors with one motor being located in each 'arm' 9 of the U-shaped supporting element 6. The motor(s) for rotating the first housing part 2' of the head 2 relative to the supporting element 6 (about the axis X) may alternatively be located inside the first housing part 2' (not shown).

By rotating the first housing part 2' of the head 2 about the horizontal axis X, the light source 11 will accordingly also be rotated about the horizontal axis X, in order to allow different points or areas to be illuminated, with a motion often referred to as a "tilt motion" of the light source.

Furthermore, the movable supporting element 6 (and thereby the first housing part 2') may be rotated about an additional predetermined axis Y preferably being an at least substantially vertical axis relative to the base 5. This rotation of the supporting element 6 may e.g. be performed by a further motor provided in the supporting element 6, e.g. centrally at the bottom of the U-shaped movable supporting element 6. The motor may—as an alternative—be located inside the second housing 5' provided by the base 5. This motor is preferably an electric motor, particularly a stepper motor.

By rotating the supporting element 6 about the vertical axis Y, the light source 11 will accordingly be rotated about the vertical axis Y, in order to allow different points or areas to be illuminated. This motion is often referred to as a "pan motion" of the light source.

The rotation about the Y axis may be provided by a motor located in the section between the 'arms' 9 of the third housing part 6' of the U- or yoke shaped supporting element 6. Alternatively, the motor for providing rotation about the Y axis may be located in the second housing part 5' of the base 5. In either case this motor is preferably an electric motor such as a stepper motor.

The motors controlling rotation about the vertical axis Y and about the horizontal axis X allows the light source to be positioned in virtually any desired angle both about the horizontal axis X and about the vertical axis Y. The light beam emitted by the light source can thus be controlled to be directed in virtually any desired direction.

The lighting device 1 is connectable to receive electrical power (not shown) and/or comprises one or more re-chargeable power sources (not shown) adapted, during use, to supply electrical power to the light source(s), the electric motor(s), the control unit(s) 7, and/or, if needed, the user interface 8.

A lighting device 1 according to the first aspect comprises at least a head 2 and a filter 30 as described below. In embodiments, where the lighting device only comprises a head 2, and not a support arrangement 4, the first housing part 2' forms the housing 1' of the lighting device. The lighting device 1 may in this case be formed to be able to be coupled to external support structures (not shown).

In other embodiments, a lighting device may comprise a head, a moveable support element 6 (and no base 5), and at least one filter 30 as described below. In such embodiments the first housing part 2' and the third housing part 6' together forms a housing 1' of the lighting device 1.

In yet other embodiments, a lighting device 1 may comprise a head 2, a base 5, a moveable support element 6, and at least one filter 30 as described below. In this case, the first housing part 2', the second housing part 5', and the third housing part 6' together forms a housing 1' of the lighting device 1.

Lighting devices 1 as described above may be used in connection with outdoors arrangement. For this purpose the lighting devices 1 needs to be protected against humidity and dust and other environmental hazards.

In order to address this, such lighting devices may be manufactured with completely closed housings where the components of the lighting devices are enclosed in a housing devoid of openings and where housing parts or shell parts of the housing parts of the housing and access hatches etc. are provided with special gaskets in order to make the lighting device 1 completely water/moisture/air tight—or at least as water/air tight as possible.

Such lighting devices may be manufactured to comply with national or international standards. For example it is desired that such lighting devices 1 may comply with the International Electrotechnical Commission (IEC) standard, e.g. IEC 60529, where the Ingress Protection Rating is IP65, IP66 or higher.

The volumes within the first housing part 2', the second housing part 5' and the third housing part 6' may be in fluid communication with each other, such that air, moisture, dust, etc. may pass between the housing parts. In such cases, an entire outer shell of the entire housing may be manufactured to apply to the standard mentioned above, IP65, IP66 or higher. Alternatively, each or a subset of the housing parts 2', 5', 6' may be have volumes, isolated from each other, and each be manufactured to apply to the standard mentioned above, IP65, IP66 or higher.

As described above, such lighting devices are equipped with motors in order to control a lighting direction. Such motors or actuators, and in some instances also rotational joints of the lighting devices, need to be lubricated in order to function correctly over prolonged periods of time.

Common lubricants and oils have an evaporation temperature, such as say 72° C.

It has been found, that the temperature inside the housings of lighting devices such as described above may occasionally reach temperatures above the evaporation temperature of the oil due to heat influx from the outside environment and/or due to heat emitted from electrical components of the lighting device during use, such as the motor(s) the light source, etc. Such elevated temperatures may cause the housing 2', 5', 6' of the lighting device 1, or any of the individual housing part 2', 5', 6' thereof to be filled with oil fumes.

According to the first aspect of the invention, the lighting device 1 comprises a filter 30 configured to filter, collect, and/or absorb any oil fumes released within the housing as such, or in a housing part 2', 5', 6' thereof. In the following, reference will be made to a filter 30. However, the filter 30 may alternatively be called oil absorbing filter or the like.

In lighting devices 1 where the housing parts are fluidly isolated from each other, each housing part 2', 5', 6'—or at least those housing parts having oil containing parts/components (oil fume emitting parts/components) may comprise such a filter. In lighting devices, where all or some of the volumes of the housing parts 2, 5', 6' are in fluid communication, a single common filter 30 may be provided, or a filter may be provided in each housing part 2', 5', 6'.

The one or more filters 30 may be active carbon filters, for example filters comprising active carbon pellets. However, any type of filter suitable for filtering oil fumes may be applied.

The filter 30 may be located in the housing or housing part, such that oil fumes emitted from an oil containing component (e.g. rotational joint such as ball bearings, and/or the motors, etc.) are directed to the filter by natural convection within the housing or housing part 2', 5', 6'.

For example, the housing/housing part 2', 5', 6' may be constructed such that oil fumes are guided past the filter. For example by arranging walls of the housing/housing part, or by providing the housing/housing part with fins and/or channels for directing the fumes in the direction of a filter 30. Also, the design of the individual components and/or their mutual arrangement may contribute to guiding oil fumes towards the filter.

For example, a filter 30 may be arranged in an vertically upper part of the first housing 2', the second housing part 5', or the third housing part 6'.

Alternatively, the filters 30 may be provided in connection with, i.e. in close proximity of, an oil-fume emitting component, such that the fumes are collected at the source. Alternatively, one or more filters may be provided in connection/close proximity of a component/part that needs to be protected from the oil fumes such as the control unit 7, the light source 11, or the light permeable closure 3'.

However, in one embodiment, a ventilation device 40, such as a fan, is provided in the housing 2', 5', 6' or in each or a subset of the housing parts 2', 5', 6' of the lighting device 1 and arranged to direct the oil fumes to the filter or filters, or at least provide forced convection in the housing 2', 5', 6' or in each or a subset of the housing parts 2', 5', 6'.

Figure 4:
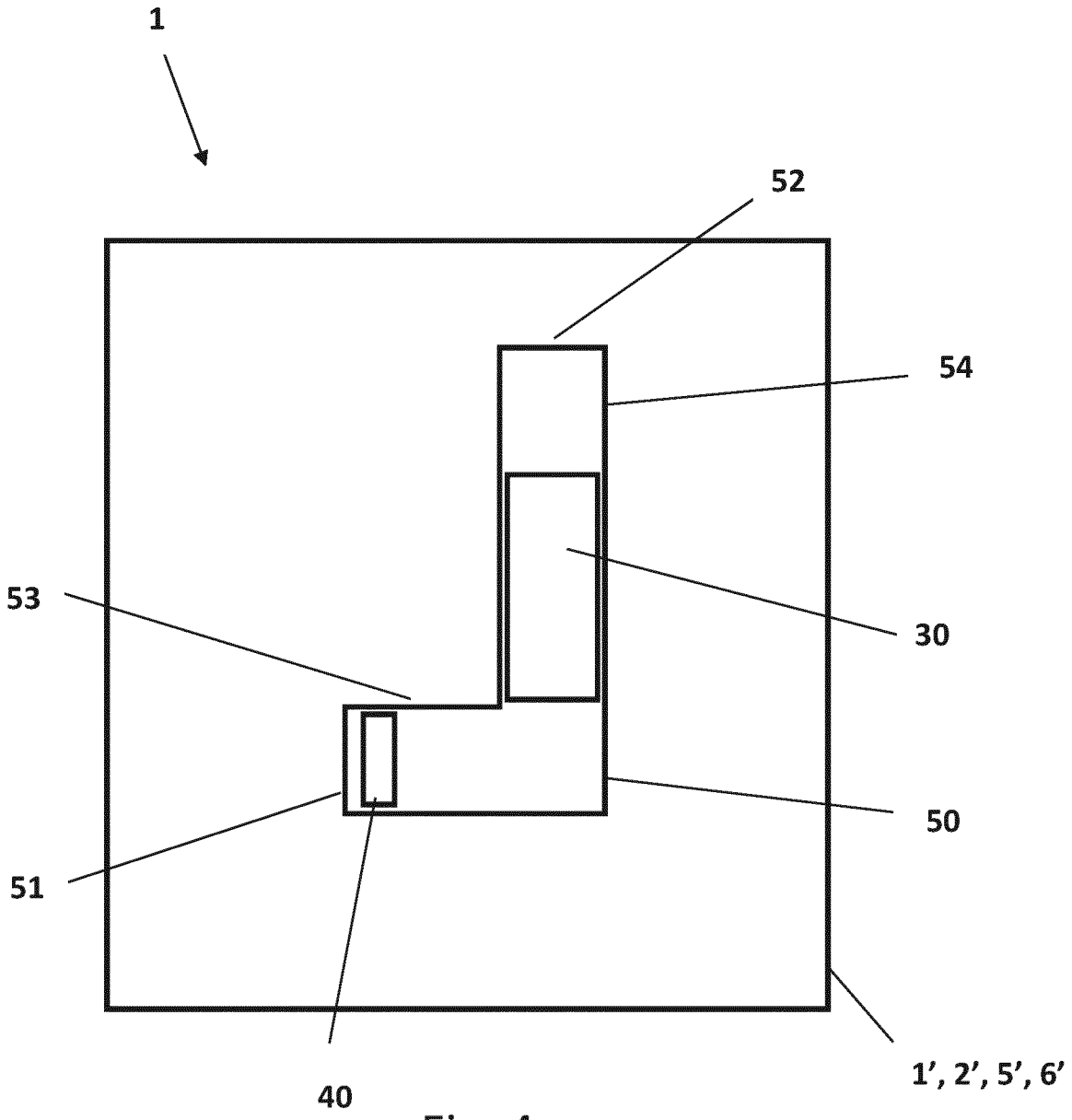
FIG. 4 schematically illustrates a cross-sectional view of a filter housing arranged in a housing part of a lighting device.

As shown in FIG. 4, a ventilation device 40, such as fan, is arranged at an inlet 51 to a filter housing 50. A filter 30, as described above is also provided within the filter housing 50. The ventilation device 40 sucks air—including the oil fumes—into the filter housing 50 and towards a filter 30. The filtered air stream exits the filter housing 50 at an exit or outlet 52. The ventilation device 40 provides forced convection within the housing 2', 5', 6' or housing part 2', 5', 6' of the lighting device 1.

The filter housing 50 may comprise an elongate channel 53 between the inlet 51 and the filter 30. In the embodiment shown in FIG. 4, the ventilation device 40 is located at the inlet 51. However, in other—not shown—embodiments, the ventilation device 40 may be provided at any location in the elongate channel 53, including immediately adjacent to the filter 30. In the embodiment shown in FIG. 4, the exit/outlet 52 from the filter housing 50 is located at the end of a channel 54 downstream of the filter 30. However, in other embodiments the exit/outlet 52 from the filter housing 50 may be located immediately adjacent to a downstream end of the filter 30.

In yet other—not shown—embodiments, a ventilation device 40, may alternatively or additionally be located downstream of the filter 30 such that air is drawn through the filter 30 by the ventilation device 40. In such cases, the downstream ventilation device 40 may be located in a section of the filter housing 50 forming a channel 54 downstream of the filter 30.

In one embodiment, a filter housing 50 with the inlet 51, the ventilation device 40 and the filter is located in the first housing part 2'. Thereby, the light source 11 and the light permeable closure 3' are protected against oil fumes condensing thereon. The exit/outlet 52 may be located in the first housing part 2'. Alternatively, in other embodiments, the exit/outlet 52 may be located in the third housing part 5' or in the second housing part 6', the exit/outlet 52 being provided at the end of an elongated downstream channel 54 extending from the filter 30 to the exit/outlet 52.

In another embodiment, the inlet 51 to the filter housing 50 is located in the first housing part 2', and the filter 30 is located in the second housing part 5' or in the third housing part 6'. In such cases, the inlet 51 is provided at one end of an elongated channel 53 upstream of the filter 30. The channel may for example be formed by flexible tubing. The ventilation device 40 may be located at the inlet 51, or it may be located downstream of the filter 30.

In a further—not shown—embodiment, the filter housing 50 comprising the filter 30 has two or more upstream channels 53, each provided with an inlet 51. The inlets 51 may be located in various locations in a housing portion 2', 5', 6', or some inlets 51 may be located in one housing part and other inlets 51 in a different one of the housing parts 2', 5', 6'. A single ventilation device 40 may provide suction for all upstream channels 53. In such case, a single ventilation device 40 may be provided downstream of the filter 30, or a single ventilation device may be provided in or at a manifold (not shown) upstream of the filter 30. Alternatively, a ventilation device 40 may be provided in each upstream channel 53, for example at each inlet 51.

A dust filter may in connection with any of the previously described embodiments further be provided downstream of the filter 30. For example, when the filter 30 is an active carbon filter, any carbon dust from the filter material may be caught by the dust filter and thereby prevent fouling of the components inside the housing. The dust filter may be a HEPA filter.

The ventilation device 40 may be controlled—for example by the control unit 7—to be active all the time when the lighting device 1 is on. In further embodiments, the ventilation device may be controlled to be active when the lighting device 1 is turned on, and for a predetermined time after it is turned off, the predetermined time being based on an expected cool-down time, where it can be expected that the temperature is below the evaporation temperature of the oil. The ventilation device 40 may alternatively or additionally be controlled—for example by the control unit 7—to be active in predetermined regular time intervals.

In further embodiments, the lighting device 1 may further comprise one or more sensors (not shown) configured to sense when there is a risk of oil fumes. Such sensors may e.g. be temperature sensors. For example a temperature sensor may be provided in the proximity of the components that may emit oil fumes. The ventilation device 40 may then be activated, e.g. by the control unit 7, based on input from a sensor measuring the temperature of the component that may emit oil fumes, when the measured temperature approaches or exceeds the evaporation temperature of the oil. A sensor may be provided for each potential oil fume emitting component. In other embodiments, one or more sensors may be located at other key locations.

The ventilation device 40 may be controlled to switch off, when input from the one or more sensors indicates that the temperature is so low that all oil fumes can be considered to have condensed and no new oil fumes are produced.

Figure 2:
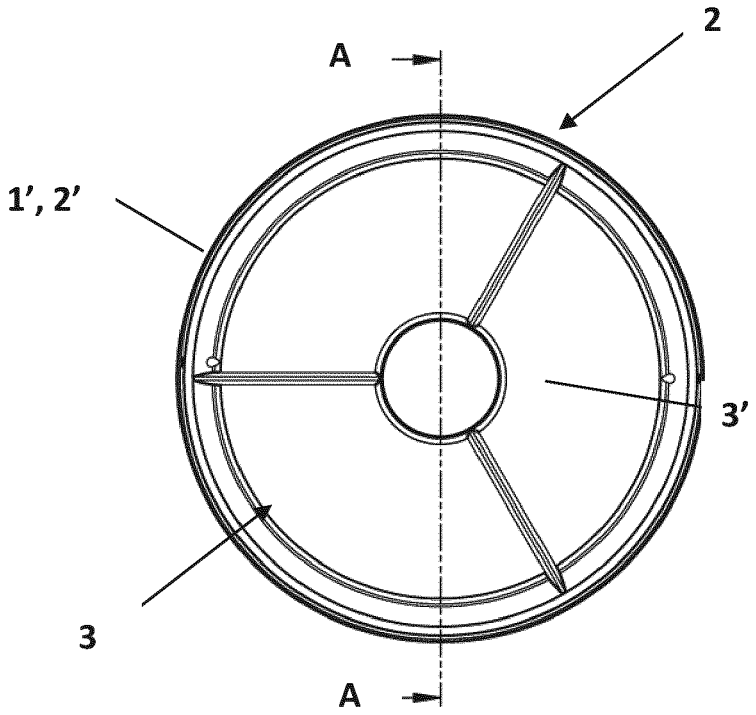
FIG. 2 schematically illustrates a front view of a head of a moving head lighting device, e.g. a lighting device generally corresponding to the one illustrated in FIG. 1.

FIG. 2 schematically illustrates a front view of a head 2 of a moving head lighting device, e.g. a lighting device 1 generally corresponding to the one illustrated in FIG. 1.

Figure 3:
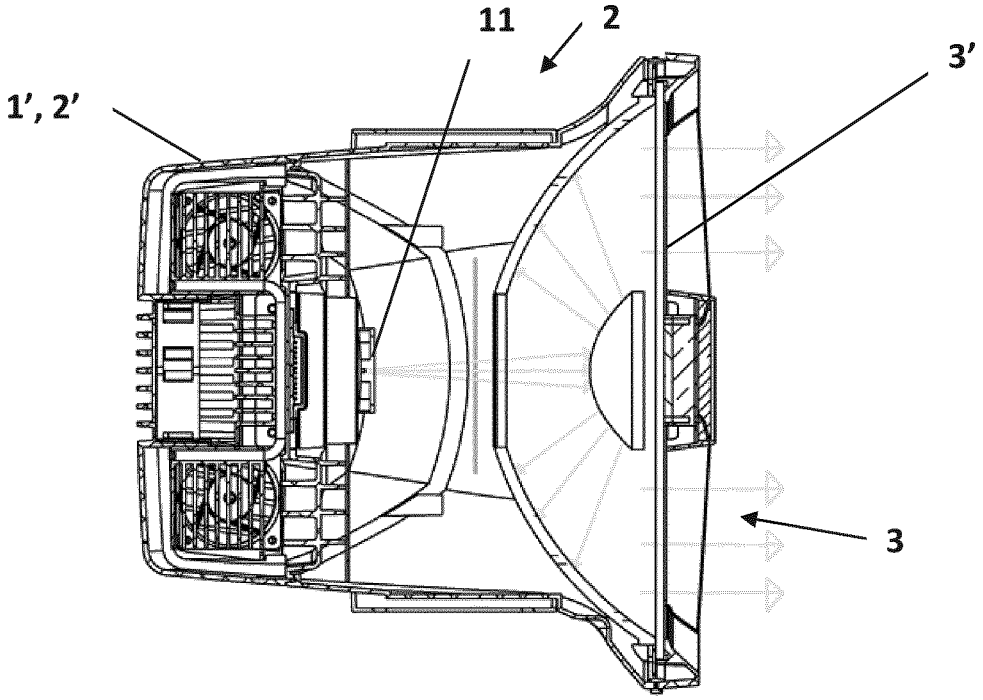
FIG. 3 schematically illustrates a cross-sectional view of a lighting device of along section A-A.

FIG. 3 schematically illustrates a cross-sectional view of a lighting device 1 of along section A-A of FIG. 2.

Some preferred embodiments have been shown in the foregoing, but it should be stressed that the invention is not limited to these, but may be embodied in other ways within the subject matter defined in the following claims.

In the claims enumerating several features, some or all of these features may be embodied by one and the same element, component or item. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, elements, steps or components but does not preclude the presence or addition of one or more other features, elements, steps, components or groups thereof.

The invention claimed is:

1. A lighting device configured for professional illumination, the lighting device comprising a head and a component emitting oil fumes, the lighting device comprising a fluid tight housing, wherein an oil fume absorbing filter is arranged within said housing, and the lighting device further comprising a ventilation device configured to force air within the housing to pass through said oil fume absorbing filter.

2. A lighting device according to claim 1, wherein the oil fume absorbing filter and the ventilation device are arranged in a filter housing comprising an inlet and an outlet, and wherein the ventilation device is arranged upstream or down stream of the filter.

3. A lighting device according to claim 2, wherein the filter housing comprises an upstream channel provided between an inlet of the upstream channel and the oil fume absorbing filter.

4. A lighting device according to claim 2, wherein the lighting device comprises a support arrangement for supporting the head, wherein the inlet to the upstream channel of the filter housing is provided in one of the head and the support arrangement, and wherein the filter is provided in the other of the head and the support arrangement.

5. A lighting device according to claim 2, wherein the inlet to the upstream channel of the filter housing is provided in the head and where an outlet from the filter housing is provided in the head.

6. A lighting device according to claim 2, wherein the filter housing comprises two or more upstream channels leading to the oil fume absorbing filter, each upstream channel having an inlet.

7. A lighting device according to claim 6, wherein each upstream channel comprises a ventilation device.

8. A lighting device according to claim 2, wherein the filter housing has as dust filter arranged downstream of the oil fume absorbing filter.

9. A lighting device according to claim 8, wherein the dust filter is a HEPA filter.

10. A lighting device according to claim 1, wherein the oil fume absorbing filter is an active carbon filter.

11. A lighting device according to claim 1, wherein the lighting device comprises a head movable relative to a support arrangement by one or more motors.

12. A lighting device according to claim 1, further comprising a control unit connected to said ventilation device and configured to activate the ventilation device, when the lighting device is turned on and deactivate the ventilation device, when the lighting device is turned off;

activate the ventilation device, when the lighting device is turned on, and deactivate the ventilation device a predetermined period of time after the lighting device is turned off; or activate the ventilation device in regular predetermined intervals of time after the lighting device is turned on.

13. A lighting device according to claim 1, further comprising a control unit connected to said ventilation device and to at least one sensor, the sensor being arranged within said housing, and being configured to detect a variable indicative of oil fumes being present in the housing, and wherein the control unit is configured to activate the ventilation device, based on input from the sensor, when the measured variable approaches or exceeds a threshold.

14. A lighting device according to claim 13, wherein the sensor is a temperature sensor, and wherein the control unit is configured to activate the ventilation device, based on input from the sensor, when the measured temperature approaches or exceeds an evaporation temperature of the oil used in the oil fume emitting components.

* * * * *